United States Patent [19]

Iijima et al.

[11] Patent Number: 5,069,127

[45] Date of Patent: Dec. 3, 1991

[54] SPOT PRINTING METHOD IN ROTARY PRESS AND BLANKET CYLINDER FOR SPOT PRINTING

[75] Inventors: Takashi Iijima; Shinji Kawashima, both of Kanagawa, Japan

[73] Assignee: Tokyo KiKai Seisakusho, Ltd., Tokyo, Japan

[21] Appl. No.: 703,571

[22] Filed: May 16, 1991

Related U.S. Application Data

[63] Continuation of Ser. No. 495,600, Mar. 16, 1990, abandoned.

[30] Foreign Application Priority Data

Mar. 18, 1989 [JP] Japan ..... 1-64960

[51] Int. Cl.[5] ..... B41F 1/28

[52] U.S. Cl. ..... 101/415.1; 29/118; 29/124

[58] Field of Search ..... 101/492, 415.1, 389.1, 101/409, 220, 382.1, 383; 29/121.2, 124, 125, 130, 118

[56] References Cited

U.S. PATENT DOCUMENTS

| | | | |
|---|---|---|---|
| 922,542 | 5/1909 | Tornbladh | 29/128 |
| 3,332,346 | 7/1967 | Luehas | 29/118 |
| 3,668,752 | 6/1972 | Clifton et al. | 29/124 |
| 3,765,329 | 10/1973 | Kirkpatrick et al. | 29/118 |
| 4,116,594 | 9/1978 | Lelanwa et al. | 29/124 |
| 4,207,815 | 6/1980 | Watanabe | 101/415.1 |
| 4,587,901 | 5/1986 | Gianfranco | 101/415.1 |
| 4,611,539 | 9/1986 | Ireton | 101/415.1 |
| 4,643,094 | 2/1987 | Holmstrom | 101/415.1 |
| 4,676,161 | 6/1987 | Peekna | 101/389.1 |
| 4,878,429 | 11/1989 | Russo | 101/389.1 |
| 5,005,477 | 4/1991 | Schroeder | 101/415.1 |
| 5,016,531 | 5/1991 | Schroeder | 101/415.1 |

*Primary Examiner*—Eugene H. Eickholt

*Attorney, Agent, or Firm*—Trexler, Bushnell, Giangiorgi & Blackstone, Ltd.

[57] ABSTRACT

When spot printing is made by opposed blanket cylinders for spot printing that are disposed on one of a pair of blanket cylinders disposed to oppose each other in a rotary press, the present invention discloses a spot printing method characterized in that a suitable number (more than two) of blankets are selected from inside the range of division width obtained by dividing the full width range of the blanket cylinder for spot printing into a suitable number (more than two) of widths and are then fitted to the blanket cylinder for spot printing, and printing is then made by the blanket cylinder for spot printing.

The present invention discloses also a blanket cylinder for spot printing which comprises a suitable number (more than two) of blankets of a width within the range of division width obtained by dividing the full width range of a blanket cylinder; and blanket fitting devices operative independently of one another within the range of division obtained by dividing the full width range of the blanket cylinder.

20 Claims, 3 Drawing Sheets

SPOT PRINTING METHOD IN ROTARY PRESS AND BLANKET CYLINDER FOR SPOT PRINTING

This application is a continuation of application Ser. No. 07/495,600, filed Mar. 16, 1990 and now abandoned.

BACKGROUND OF THE INVENTION

1. Field of the Invention

This invention relates to a spot printing method in a rotary press with a spot printing function which has a plate cylinder having fitted thereto a plurality of plates, and to a blanket cylinder for spot printing.

2. Description of the Prior Art

In an offset rotary press with a spot printing function having a plate cylinder to which a plurality of plates are fitted, a pair of blanket cylinders are disposed to face each other and blanket cylinders for spot printing are fitted to one of the blanket cylinders at its upper part, for example. Each plate is fitted to each blanket cylinder.

A paper web is first clamped between the pair of rotating blanket cylinders and printing is made simultaneously on both surface of the paper web. While keeping contact with one of the blanket cylinders, the paper web is further interposed by the blanket cylinder for spot printing and spot printing is additionally made to one of its surfaces.

Therefore, in the printing process, the paper web continuously receives twice the printing pressure by the other of the blanket cylinders and the blanket cylinder for spot printing while being wound on one of the pair of blanket cylinders.

The prior art technique relating to fitting of the blanket to the blanket cylinder in a rotary press is described, for example, in Japanese Utility Model Publication No. 10001/1975 and Japanese Utility Model Laid-Open No. 39865/1980.

In the former reference, the blanket is fitted to the blanket cylinder by fitting both ends of the blanket to a take-up shaft disposed rotatably in an axial direction in the proximity of the outer peripheral surface of the blanket cylinder, rotating then both ends of the take-up shaft through worm gears and winding the blanket. The blanket and the take-up shaft are single throughout the entire length of the blanket cylinder, respectively.

In the latter, the blanket is fitted to the blanket cylinder by fitting fillet bars at both ends of the blankets into grooves formed on the peripheral surface of the blanket cylinder in the axial direction, further setting them into a groove formed in the axial direction on the peripheral surface of a tension bar disposed rotatably inside the groove, rotating the tension bar and thus winding the blanket. The blanket and the tension bar are divided into two units at the center of the blanket cylinder, respectively.

Generally, in an offset rotary press with a spot printing function having a plate cylinder to which a plurality of plates are fitted, a phase difference occurs between the surface of a paper web wound to one of the rotating blanket cylinders and the peripheral surface of the blanket cylinder due to minute variation of tension of the paper web, elongation of the paper web, delicate creases, and the like, though the paper web is kept wound on the blanket cylinder. If the printing pressure of the second time due to spot printing is applied in succession to the first printing pressure, so-called "double", wherein characters, patterns, and the like, that are printed on the opposed web surface from the blanket cylinder on which the web is wound become thicker or get doubled vertically or horizontally, is likely to occur.

This "double" invites a remarkable drop of quality of the printed matters and must therefore be avoided by all means.

According to the blanket cylinder equipped with the blanket fastening device in accordance with the prior art, the printing pressure is applied to the full width of the blanket cylinder for spot printing, inclusive of unnecessary zones, even when printing is not necessary for the full width of the blanket cylinder in spot printing (such as when spot printing is made to only part of pages of a plurality of pages in the transverse direction, for example).

Even if a blanket having a half width is selected and fitted independently to the blanket cylinder, though such an arrangement is not disclosed in the afore-mentioned Japanese Utility Model Laid-Open No. 39865/1980, the printing pressure is applied unavoidably to the paper web inclusive of the unnecessary zones in spot printing covering only a ¼ width (e.g. for one page), for example.

SUMMARY OF THE INVENTION

When spot printing is made by a blanket cylinder for spot printing fitted further to one of a pair of blanket cylinders disposed to face each other in a rotary press, the spot printing method in a rotary press in accordance with the present invention selects a suitable number (more than two) of blankets of a width within the range of division width obtained by dividing suitably (by more than two) the full width range of the blanket cylinder for spot printing, fits the selected blankets to the blanket cylinder for spot printing and thereafter makes spot printing by use of the blanket cylinder for spot printing.

The blanket cylinder for spot printing of the present invention for use in the spot printing method in a rotary press includes a suitable number (more than two) of blankets within the range of a division width obtained by dividing (by four, for example) the full width range of the blanket cylinder, and blanket fitting device each being operative independently within each of a plurality of division width ranges. The blanket fitting devices include the following types, for example.

The first type comprises a fitting groove formed on the outer peripheral surface of the blanket cylinder in the axial direction, divided tension bars disposed in divided blanket cylinders formed by halving further the half width range of the full width range of the blanket cylinder, and operation devices for operating individually the divided tension bars. The second type comprises a fitting groove formed on the outer peripheral surface of the blanket cylinder in the axial direction, and a support bars corresponding individually to each blanket fitted into the fitting groove, for pulling and fastening both ends of the blanket into the fitting groove.

In the blanket cylinder for spot printing described above, only a necessary divided blanket or blankets having a width within the division width obtained by dividing the full width of the blanket cylinder are wound onto the necessary positions of the blanket cylinder, and each divided blanket is fitted or removed individually to and from the blanket cylinder by the respective blanket fitting device.

In the blanket fitting device of the tension bar type, only the necessary divided blanket is wound onto the necessary position of the blanket cylinder, the end portion of each divided blanket is fitted into the fitting groove and is pulled and fastened individually by the operation of the corresponding tension bar so as to individually fit and remove the divided blanket to and from the blanket cylinder.

In the blanket fitting device of the support bar type, only the necessary divided blanket is wound onto the necessary position of the blanket cylinder, the end portion of each divided blanket is fitted into the fitting groove and the divided support bar corresponding to the divided blanket is fitted into the fitting groove so as to pull and fix both ends of the blanket into the fitting groove. In this manner, the divided blanket can be fitted into the blanket cylinder and can be removed individually from the blanket cylinder.

If either of the blanket fitting devices for fitting the blanket is used, only the necessary blanket for spot printing can be fitted and removed easily to and from the necessary position of the blanket cylinder for spot printing and this fitting and removal can be made independently of fitting and removal of the other divided blankets. Thus, it is possible to eliminate the blanket from the outer peripheral surface of the blanket cylinder for spot printing other than the necessary divided blanket fitting zone.

When spot printing is made by use of the blanket cylinder for spot printing fitted to one of the pair of blanket cylinders disposed to face each other, an unnecessary printing pressure by the blanket cylinder for spot printing is not applied to the printing surface of the paper web which is not to be spot-printed.

The above and other objects and novel features of the present invention will become more apparent from the following detailed description when taken in conjunction with the accompanying drawings.

DESCRIPTION OF THE PREFERRED EMBODIMENT

Figure 1:
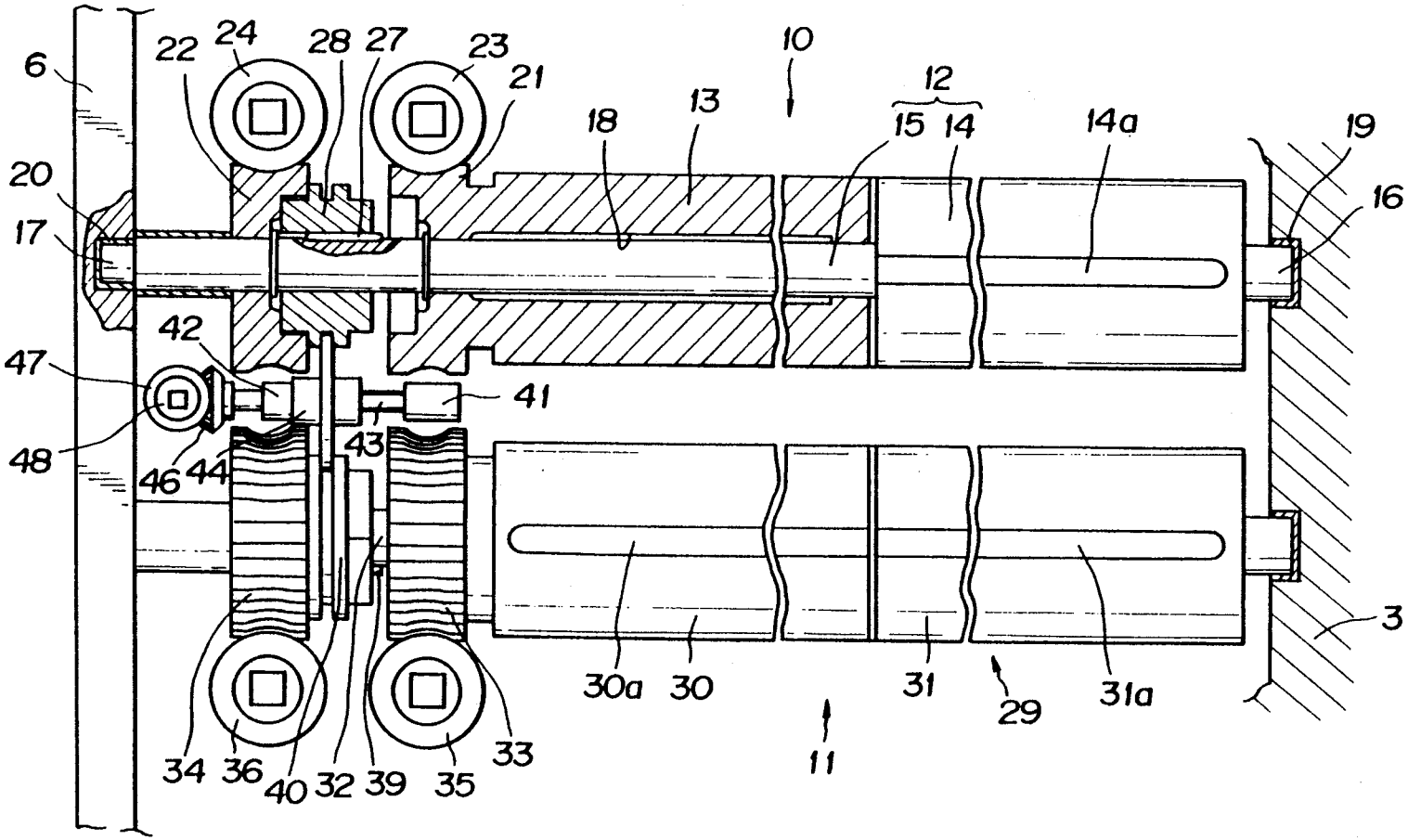
FIG. 1 is a partial sectional view of a blanket cylinder in a rotary press in accordance with one embodiment of the present invention.

Hereinafter, a preferred embodiment of the present invention will be described with reference to the accompanying drawings.

An embodiment of the spot printing method in a rotary press in accordance with the present invention is practised by use of a blanket cylinder of this invention shown in the drawings.

First of all, an example of the blanket cylinder for spot printing will be explained with reference to the drawings.

Figure 2:
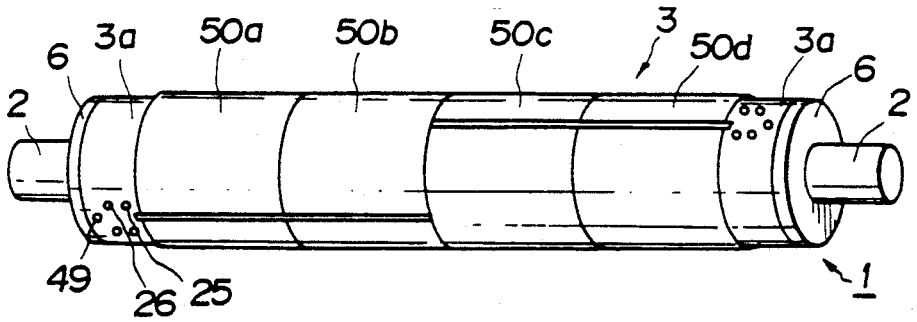
FIG. 2 is a perspective view of the blanket cylinder of the rotary press in one embodiment of the present invention.
Figure 3:
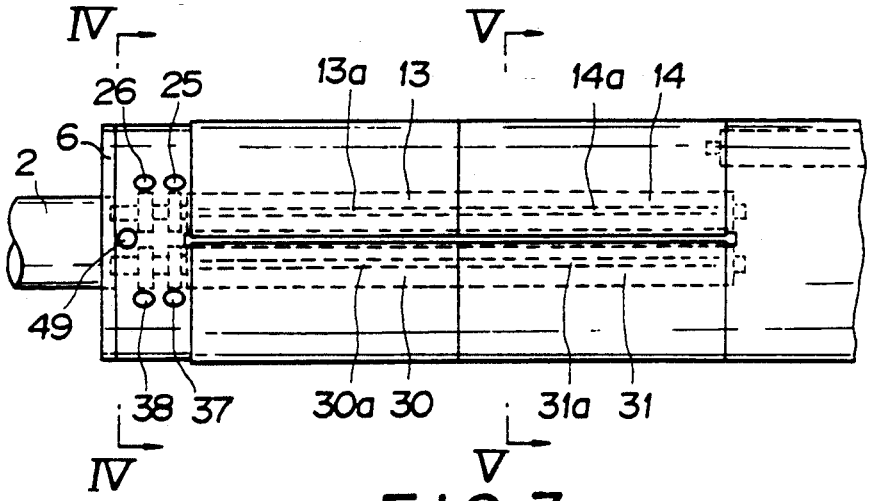
FIG. 3 is a partial front view of the blanket cylinder of the rotary press shown in FIG. 2.

The blanket cylinder 1 shown in FIG. 2 is equipped with the structures shown in FIGS. 1 and 3 to 5 with their phases being deviated around the axis on the right and left sides in the longitudinal direction as shown in FIG. 2.

The left half portion of the blanket cylinder 1 in FIG. 2, particularly a blanket fitting device in the blanket cylinder 1, will be explained.

Figure 4:
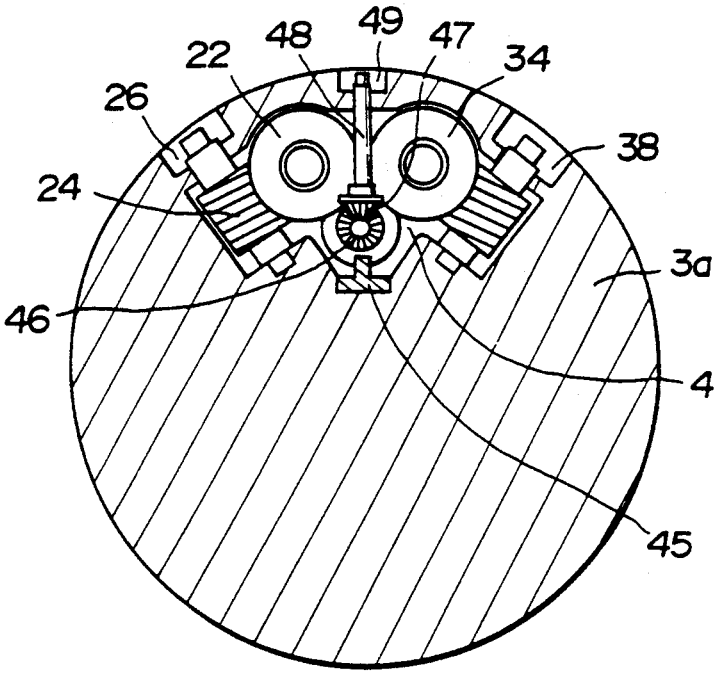
FIG. 4 is a sectional view taken along line IV—IV of FIG. 3.
Figure 5:
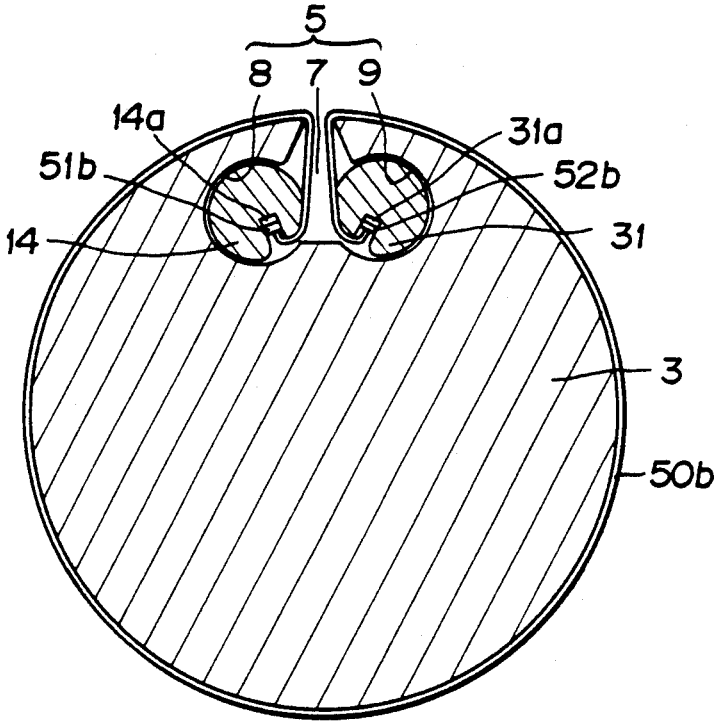
FIG. 5 is a sectional view taken along line V—V of FIG. 3.

A cavity 4 having a section such as shown in FIG. 4 is formed at the end portion 3*a* of a blanket cylinder main body 3 equipped with a journal 2 continuing the end surface. This cavity 4 is formed in the proximity of the outer peripheral surface and opens to the end surface. A groove 5 having a section such as shown in FIG. 5 is formed in such a manner as to continue the cavity 4 and to extend to the center position of the blanket cylinder main body 3 in its axial direction.

A ring plate 6 for covering the cavity 4 is removably fitted to the end surface of the blanket cylinder main body 3 while being inserted into the journal 2.

The groove 5 consists of an intermediate groove portion opening to the outer peripheral surface of the blanket cylinder main body 3, that is, a fitting groove 7, and two parallel hole-like portions 8, 9 which communicate with each other through the fitting groove 7.

A tension bar is fitted into each hole-like portion 8, 9 of the groove 5. The tension bar 10 of the hole-like portion 8 has the same structure as the tension bar 11 of the hole-like portion 9. Therefore, the explanation will be given on the structure of the tension bar 10 of the hole-like portion 8 with the corresponding portion of the tension bar 11 being indicated by reference numeral with parenthesis.

The tension bar 10 (11) consists of a first tension bar 12 (29) and a second tension bar 13 (30). The first tension bar 12 (29) has the shape formed by connecting coaxially a bar main body 14 (31) having a length substantially a half of the length of the groove 5 to a shaft portion 15 (32) in the axial direction. They may be shaped integrally with each other or may be formed by fitting and coupling separate members. Journals 16, 17 (not shown) are formed at their tips, respectively. In the same way as the bar main body 14 (31) of the first tension bar 12 (29), the second tension bar 13 (30) has a shaft hole 18 (not shown) which has a length substantially a half of the length of the groove 5 and into which the shaft portion 15 (32) of the first tension bar 12 (29) is fitted. Furthermore, winding grooves 14*a*, 13*a* (31*a*, 30*a*) in the axial direction are formed on the peripheral surfaces of the bar main body 14 (31) of the first tension bar 12 (29) and of the second tension bar 13 (30) throughout their entire length.

Since the shaft portion 15 (32) of the first tension bar 12 (29) is fitted into the shaft hole 18 (not shown) of the second tension bar 13 (30), the second tension bar 13 (30) is rotatably fitted to the first tension bar 12 (29). The first tension bar 12 (29) is rotatably fitted to the blanket cylinder 1 since its journal 16 (not shown) on the main body side is supported by the bearing bush 19 (not shown) fitted to the bottom of the hole-like portion 8 (9) and the journal 17 (not shown) on the shaft portion side is supported by the bearing bush 20 (not shown) fitted to the ring plate 6 on the end surface of the blanket cylinder main body 3.

A worm wheel 21 (33) is formed integrally at the end portion of the second tension bar 13 (30) on the ring plate 6 side inside the cavity 4 of the blanket cylinder main body 3. (A separate worm wheel may be fixed, too). Another worm wheel 22 (34) is rotatably supported by the shaft portion 15 (32) between the worm wheel 21 (33) and the ring plate 6. Worms 23, 24 (35, 36) meshing with the worm wheels 21, 22 (33, 34) in the cavity 4, respectively, are fitted rotatably and in the radial direction of the blanket cylinder main body 3 and the outer end of each of them serves as an operation end that projects into a winding adjustment hole 25, 26 (37, 38) which is formed on the outer peripheral surface of the end portion 3*a* of the blanket cylinder main body 3.

A clutch member 28 (40) is fitted to the shaft portion 15 (32) through a sliding key 27 (39) between the worm wheel 21 (33) and the worm wheel 22 (34). The clutch member 28 (40) moves on the shaft portion 15 (32) in the axial direction and selectively engages with the worm wheel 21 (33) and with the worm wheel 22 (34).

In one example of switch moving means of the clutch members 28, 40, a screw rod 43 which is in parallel with both shaft portions 15, 32 is supported rotatably by stopper members 41, 42 which are implanted with a predetermined gap between them in the longitudinal direction at the bottom of the cavity 4 and at the intermediate portion of both shaft portions 15, 32 in the proximity of the worm wheels 21, 33; 22, 34, and a shifter 44 engaging with both clutch members 28, 40 meshes with this screw rod 43 between both stopper members 41, 42 while its rotation around the axis of the rod is limited by a guide 45.

A bevel gear 46 is fitted to the projecting end portion of the screw rod 43 and another bevel gear 47 meshing with the bevel gear 46 is fitted to the inner end of a switch shaft 48. This switch shaft 48 is in turn fitted rotatably and in the radial direction of the blanket cylinder main body 3. The outer end of this switch shaft 48 serves as an operation end which projects into a clutch switch hole 49 bored on the outer peripheral surface of the end portion 3*a* of the blanket cylinder main body 3.

Besides the example described above, a pneumatic cylinder or a compact motor can be utilized as the operation means of the shifter 44. An electromagnetic clutch may be used for the clutch itself.

The operation for fitting the blanket 50*a*, 50*b* onto the blanket cylinder 1 by the blanket fitting device described above will now be explained.

After each blanket 50*a*, 50*b* is wound on the blanket cylinder main body 3, fillet bars 51*a*, 52*a*; 51*b*, 52*b* at its both ends are inserted into the insertion groove 7. Then, the fillet bar 51*a* of the blanket 50*a* is inserted into the winding groove 13*a* of the second tension bar 13 of the tension bar 10 and the fillet bar 52*a* of the blanket 50*a*, into the winding groove 30*a* of the second tension bar 30 of the tension bar 11. The fillet bar 51*b* of the blanket 50*b* is inserted into the winding groove 14*a* of the first tension bar 12 of the tension bar 10, and the fillet bar 52*b* of the blanket 50*b*, into the winding groove 31*a* of the first tension bar 29 of the tension bar 11.

The switch shaft 48 is then rotated by inserting a tool into the clutch switch hole 49. The screw rod 43 is rotated through the bevel gears 46, 47 and the shifter 44 is switched and moved until it strikes the stopper member 41. Then, the clutch member 28 engages with the worm wheel 21 and the clutch member 40, with the worm wheel 33.

Next, the worms 23, 35 are rotated by inserting the tool into the winding adjustment holes 25, 37 to thereby rotate the worm wheel 21 clockwise in FIG. 4 and the worm wheel 33 counterclockwise in FIG. 4. Then, both second tension bars 13, 30 rotate directly and both first tension bars 14, 29 rotate through the clutch members 28, 40 and through sliding keys 27, 39, respectively.

In this manner, each blanket 50*a*, 50*b* is wound from both of its ends into each tension bar and is thus fitted onto the blanket cylinder main body 3.

Since the rotation of each tension bar is the irreversible rotation through the worm gears, fitting of the blanket 50*a*, 50*b* does not get loose.

Each blanket 50*a*, 50*b* can be removed from the blanket cylinder main body 3 in the following way. Namely, the tool is inserted into each winding adjustment hole 25, 37 to rotate each worm 23, 35 in the opposite direction to the direction of fitting. Then, both first tension bars 14, 29 and both second tension bars 13, 30 rotate in the opposite direction to the direction of fitting and the blanket 50*a*, 50*b* can thus be rewound from each tension bar. At this time, the fillet bars 51*a*, 52*a*; 51*b*, 52*b* at both ends of each blanket 50*a*, 50*b* are pulled out from each winding groove and then from the fitting groove 7. The blanket 50*a*, 50*b* can thus be removed from the blanket cylinder main body 3.

Since the tension bar 10 and the tension bar 11 can be rotated independently of each other, it is possible to fit and remove independently each blanket 50*a*, 50*b* to and from the blanket cylinder main body 3.

When only one of the blankets 50*a*, 50*b* is removed from the blanket cylinder main body 3, for example, the switch shaft 48 is rotated by inserting the tool into the clutch switch hole 49, the screw rod 43 is then rotated through the bevel gear 46, 47 and the shifter 44 is switched and moved until it strikes the stopper member 42. Then, the clutch member 28 engages with the worm wheel 22 and the clutch member 40, with the worm wheel 34.

When the blanket 50*a* is removed from the blanket cylinder main body 3, therefore, the tool is inserted into the winding adjustment holes 25, 37 and when the blanket 50*b* is removed from the blanket cylinder main body 3, the tool is inserted into the winding adjustment holes 26, 38. The worms 23, 35 are then rotated in the opposite direction to the direction of fitting. The subsequent procedure is the same as that of the removing operation described above.

As can be understood from the description given above, it is possible to rotate either normally or reversely both tension bars 10 and 11 independently of each other and moreover, to rotate each first tension bar 12, 19 and each second tension bar 13, 30 in each tension bar 10, 11 either simultaneously or individually by selecting arbitrarily one of them. For this reason, fitting and removal of the blankets 50*a*, 50*b* to and from the blanket cylinder 1 can be made suitably and selectively.

As described already, the blanket cylinder 1 is equipped with the structure shown in FIGS. 1 and 3 to 5 on the right and left sides thereof in the longitudinal direction with their phases being deviated around the axis as shown in FIG. 2. Accordingly, the blankets 50*c*, 50*d* can be fitted to and removed from the blanket cylinder 1 (the right half portion in FIG. 2) suitably and selectively.

It is customary to set the width of each blanket 50*a*, 50*b*, 50*c*, 50*d* in match with the width of the unit printing surface that is aligned in the transverse direction of the paper web, that is, the width of each printing plate. In the case of newspaper printing, for example, it is set to one page of the newspaper, and may be below the length of each tension bar. In such a case, positioning of each blanket in the transverse direction can be selected within the range of the length of each winding groove.

Figure 6:
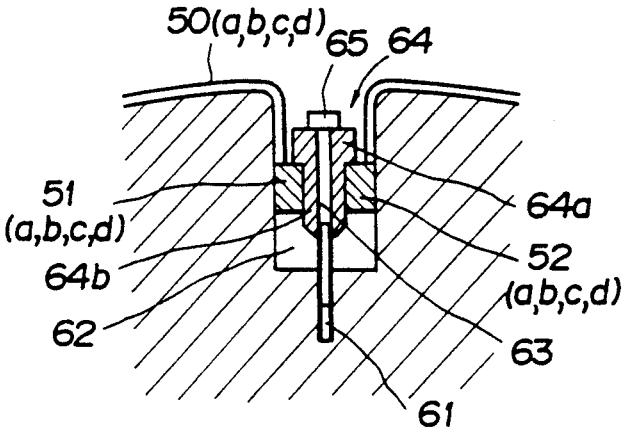
FIG. 6 is a partial sectional view of the blanket cylinder of the rotary press in accordance with another embodiment of the present invention.
Figure 7:
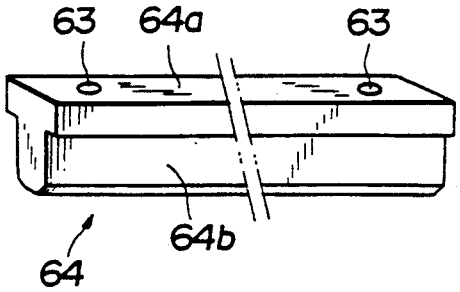
FIG. 7 is a perspective view of a support bar in FIG. 6.

Besides the embodiment of the blanket fitting device using the tension bars 10, 11 described above, there is a blanket fitting device having a structure such as shown in FIGS. 6 and 7.

This structure comprises a groove portion or a fitting groove 62 which is formed on the outer peripheral surface of the blanket cylinder main body 3 and has a rectangular sectional shape at the bottom of which a suitable number of screw holes 61, 61, . . . are bored with predetermined gaps between them in the longitudinal direction; a support bar 64 which can be fitted into the fitting groove 62 with some margins in the transverse direction, is equipped with bolt holes 63, 63 matching with the screw holes 61, 61 formed on the bottom surface of the fitting groove 62 when it is fitted into the fitting groove 62, and has a T-shaped sectional shape; and bolts 65, 65 . . . which are fitted into the bolt holes 63, 63 . . . and mesh with the screw holes 61, 61. This support bar 64 is divided into the length in accordance with the width of the blanket 50 having a small width (corresponding to the width of one page, for example). The gap and position of the screw holes 61 bored on the bottom surface of the fitting groove 62 are determined suitably in accordance with the former.

The fitting operation of each blanket 50*a*, 50*b*, 50*c*, 50*d* onto the blanket cylinder 1 by the blanket fitting device using the support bar 64 having a T-shaped sectional shape described above will now be explained.

The blanket 50*a*, 50*b*, 50*c*, 50*d* which is selected suitably is wound onto the blanket cylinder main body 3 at the position in the axial direction which is selected suitably, and the fillet bars 51*a*, 52*a*; 51*b*, 52*b*; 51*c*, 52*c*; 51*d*, 52*d*; at both ends are inserted into the fitting groove 62. After being placed in parallel with the fitting groove 62, the leg portion 64*b* with its head 64*a* facing upward is inserted between the fillet bars at both ends and the support bar 64 of each blanket is inserted into the fitting groove 62. Then, the fillet bars at both ends engage with the lower surface of the head 64*a* of the support bar 64.

The bolts 65, 65, . . . are then fitted into the bolt holes 63, 63, . . . and screwed into the screw holes 61, 61 by use of the tool, and the fillet bars 51, 52 at both ends of each blanket 50 are pushed into the fitting groove 62 and clamped by it by the support bar 64. In this manner, each blanket 50 can be fitted individually to the predetermined position of the blanket cylinder main body 3.

When the blanket 50 is removed from the blanket cylinder main body 3, the bolts 65, 65, . . . are removed from the screw holes 61, 61 and the support bar 64 is then removed from inside the fitting groove 62. In this manner, the fillet bars 51, 52 at both ends of each blanket 50 are released and each blanket 50 can be removed individually from the blanket cylinder main body 3.

Accordingly, when the spot printing of the present invention is made by use of the blanket cylinder for spot printing to which the blanket is fitted by either type of the blanket fitting device for fitting the blanket to the blanket cylinder described above, the blanket does not exist on the outer peripheral surface of the blanket cylinder for spot printing at other portions than the necessary zone (spot printing page zone) because only the divided, necessary blanket for spot printing is independently fitted to the necessary zone (spot printing page zone) of the blanket cylinder. In other words, an unnecessary printing pressure is not applied to the zones other than the necessary zone (spot printing page zone).

According to the present invention described above, only the necessary, divided blanket can be fitted and removed easily and independently to and from the blanket cylinder for a rotary press, particularly the blanket cylinder for spot printing in spot printing, and any blanket does not exist on the other peripheral surfaces of the blanket cylinder. Accordingly, during the printing process in a rotary press with spot printing having a plate cylinder having a plurality of plates, in particular, even if the printing pressure of the second time is applied continuously to the paper web which is kept wound on one of a pair of rotating blanket cylinders while being in contact again with the blanket cylinder for spot printing, the range of application of the pressure is limited only to the range of spot printing. For this reason, the range of occurrence of so-called "double", which invites a remarkable drop of printing quality, does not extend to unnecessary ranges where spot printing is not effected.

Moreover, working efficiency is high because fitting and removal of the divided blanket can be carried out entirely independently of fitting and removal of other divided blankets.

Although the present invention has thus been described definitely with one preferred embodiment thereof, the invention is not particularly limited thereto, and many changes or modifications can of course be made without departing from the scope and spirit thereof.

What is claimed is:

1. A blanket cylinder assembly for particular use in spot printing by multiple blankets in a rotary press operation, comprising:

a. a blanket cylinder main body;

b. at least a pair of printing blanket members mountable on said cylinder body; and c. blanket fitting means for selectively either;

(i) coupled, simultaneously tightening both of said blanket members on said cylinder body; or (ii) tightening one of said blanket members on said cylinder body independently of the other of said blanket members.

2. A blanket cylinder assembly according to claim 1 wherein said blanket fitting means comprises a tensioning mechanism for tensioning said blanket members in said selective tightening on said cylinder body.

3. A blanket cylinder assembly according to claim 2 wherein said tensioning mechanism comprises at least one segmented tensioning bar including a first portion to which an end of a first of said blanket members is securable and a second portion to which an end of a second of said blanket members is securable for said tensioning.

4. A blanket cylinder assembly according to claim 3 wherein said tensioning mechanism comprises a coupled pair of said segmented tensioning bars for respective securement of two ends of each said blanket member.

5. A blanket cylinder assembly according to claim 3 wherein said first and second tensioning bar portions are co-axially aligned.

6. A blanket cylinder assembly according to claim 5 wherein said tensioning mechanism further comprises control means for selectively controlling either:

(i) simultaneous rotation of said first and second tensioning bar portions in order to tension both of said blanket members; or (ii) rotation of either of said first or second tensioning bar portions independently for tensioning only one of said blanket members.

7. A blanket cylinder assembly according to claim 5 wherein said first tensioning bar portion comprises bearing means for rotationally supporting said second tensioning bar portion.

8. A blanket cylinder assembly according to claim 7 wherein said bearing means comprises a central bearing shaft on which said second tensioning bar portion is rotationally supported.

9. A blanket cylinder assembly according to claim 3 further comprising clutch means for selective co-rotational coupling or uncoupling said first and second tensioning bar portions for selective simultaneous tensioning of said first and second blanket members.

10. A blanket cylinder assembly according to claim 4 wherein said clutch means comprises co-activated first and second clutch members respectively coupling said respective portions of said tensioning bars for said selective simultaneous tightening of said blanket members.

11. A blanket fitting mechanism for particular use in tightening multiple printing blanket members mountable on a blanket cylinder main body for spot printing in a rotary press operation, said blanket fitting mechanism comprising:

blanket tightening means for selectively either:

a. coupled, simultaneously tightening at least a pair of said blanket members on said cylinder body; or b. tightening one of said blanket members on said cylinder body independently of the other of said blanket members.

12. A blanket fitting mechanism according to claim 11 wherein said blanket tightening means comprises a tensioning mechanism for tensioning said blanket members in said selective tightening on said cylinder body.

13. A blanket fitting mechanism according to claim 12 wherein said tensioning mechanism comprises at least one segmented tensioning bar including a first portion to which an end of a first of said blanket members is securable and a second portion to which an end of a second of said blanket members is securable for said tensioning.

14. A blanket fitting mechanism according to claim 13 wherein said tensioning mechanism comprises a coupled pair of said segmented tensioning bars for respective securement of two ends of each said blanket member.

15. A blanket fitting mechanism according to claim 13 wherein said first and second tensioning bar portions are co-axially aligned.

16. A blanket fitting mechanism according to claim 15 wherein said tensioning mechanism further comprises control means for selectively controlling either:

(i) simultaneous rotation of said first and second tensioning bar portions in order to tension both of said blanket members; or (ii) rotation of either of said first or second tensioning bar portions independently for tensioning only one of said blanket members.

17. A blanket fitting mechanism according to claim 15 wherein said first tensioning bar portion comprises bearing means for rotationally supporting said second tensioning bar portion.

18. A blanket fitting mechanism according to claim 17 wherein said bearing means comprises a central bearing shaft on which said second tensioning bar portion is rotationally supported.

19. A blanket fitting mechanism according to claim 13 further comprising clutch means for selective co-rotational coupling or uncoupling said first and second tensioning bar portions for selective simultaneous tensioning of said first and second blanket members.

20. A blanket fitting mechanism according to claim 14 wherein said clutch means comprises co-activated first and second clutch members respectively coupling said respective portions of said tensioning bars for said selective simultaneous tightening of said blanket members.

* * * * *